United States Patent [19]

Farris

[11] Patent Number: 4,804,063

[45] Date of Patent: Feb. 14, 1989

[54] AUXILIARY SAFETY STEP FOR ROUND LADDER RUNGS

[76] Inventor: Ben J. Farris, 304 Burleson, Smithville, Tex. 78957

[21] Appl. No.: 220,574

[22] Filed: Jul. 18, 1988

[51] Int. Cl.[4] ..... E06C 7/08

[52] U.S. Cl. ..... 182/121; 182/228

[58] Field of Search ..... 182/120, 121, 122, 228; 248/210

[56] References Cited

U.S. PATENT DOCUMENTS

| | | | |
|---|---|---|---|
| 2,488,633 | 11/1949 | Linder et al. | 182/120 |
| 2,528,317 | 10/1950 | Newman | 182/120 |
| 2,557,270 | 6/1951 | Franklin et al. | 182/120 |
| 2,709,626 | 5/1955 | Woodburn | 182/121 |
| 2,805,104 | 9/1957 | Johnson | 182/120 |
| 2,876,047 | 3/1959 | La Plante | 182/121 |
| 2,948,350 | 8/1960 | Bohannan | 182/121 |
| 2,992,697 | 7/1961 | Klages | 182/228 |
| 3,112,811 | 12/1963 | Moran | 182/120 |
| 3,276,543 | 10/1966 | Kanoza | 182/122 |
| 3,503,468 | 3/1970 | Taylor | 182/121 |
| 4,241,807 | 12/1980 | McKenna | 182/121 |
| 4,437,544 | 3/1984 | Anderson et al. | 182/120 |

FOREIGN PATENT DOCUMENTS

| | | | |
|---|---|---|---|
| 1436743 | 3/1966 | France | 182/228 |
| 2454511 | 11/1980 | France | 182/120 |
| 485108 | 3/1970 | Switzerland | 182/120 |
| 2185775 | 7/1987 | United Kingdom | 182/228 |

*Primary Examiner*—Reinaldo P. Machado

*Attorney, Agent, or Firm*—Dennis T. Griggs

[57] ABSTRACT

An auxiliary safety step for a ladder of the type having fluted round rungs defining a plurality of circumferentially spaced longitudinal ribs. A traction body defining a step tread includes an arcuate surface along the underside adapted to embrace the ladder rung. A pair of parallel longitudinal ribs extending laterally outward the arcuate surface interfit into the grooved recesses between adjacent ribs of the rung. A set screw secures the interfit position against separation. Support bars pivotally mounted on the body are adapted for attachment to a similar support bar of a second auxiliary step on a successive rung. The interconnected bars cooperate in stabilizing adjoining safety steps against inadvertent rotation relative to the rungs on which they are placed.

9 Claims, 2 Drawing Sheets

AUXILIARY SAFETY STEP FOR ROUND LADDER RUNGS

FIELD OF THE INVENTION

This invention relates to safety step attachments for ladders.

BACKGROUND OF THE INVENTION

Conventional round-rung extension ladders used by painters, carpenters and construction workers are frequently uncomfortable and may be dangerous to use because of the inadequate support provided by the round rungs of the ladder. Workmen using such ladders frequently stand on a single rung for a protracted length of time, causing fatigue and discomfort to their feet and legs due to the relatively narrow area of support provided by the rungs. Because the rungs have a rounded section they can also be hazardous because of little more than tangential contact with the sole of the user's shoes thereby providing minimal resistance to slippage.

BACKGROUND OF THE PRIOR ART

Most ladders when purchased are provided with either flat or round rungs as the standard construction. Round rungs are more common in the comparatively lower cost units and are the ones most likely to be associated with both greater discomfort and a higher potential for hazard. This is generally attributed to long periods of standing and/or repeated climbing of the ladder during which the highly localized round rung engagement with the feet tend to cause a rapid onset of distress. Even flat rungs having insufficient width can produce similar discomfort causing premature fatigue.

A variety of auxiliary step constructions have been proposed for eliminating the discomfort associated with normal rung ladders. Such constructions typically provide a relatively large width flat step tread and are adapted to be detachably mounted onto one or more of the permanent ladder rungs. Latches, bolts or bracing that accompany the auxiliary step constructions are typically secured to the side rails or to adjacent rungs for preventing inadvertent failure of the step when stepped on by the user.

Auxiliary step attachments are shown in the disclosures of the following U.S. Pat. Nos.:

| | | |
|---|---|---|
| 2,730,412 | 3,112,811 | 3,422,923 |
| 3,503,468 | 4,482,030 | 4,618,030 |
| 2,941,617 | 2,585,150 | 3,511,338 |
| 2,899,011 | 2,805,104 | 4,437,544 |
| 4,401,187 | 1,735,003 | 1,718,885 |
| 2,557,270 | 2,488,633 | 2,415,289 |
| 1,920,552 | 1,820,315 | 2,726,901 |
| 2,709,626 | 2,148,958 | 4,646,878 |
| 4,687,075 | | |

OBJECTS OF THE INVENTION

It is therefore an object of the invention to provide an improved auxiliary safety step for detachable mounting onto round ladder rungs.

Yet another object of the invention is to provide an auxiliary safety step in which a minimum effort and time is required for attaching and detaching the step.

It is a still further object of the invention to provide an auxiliary safety step construction for round rung ladders which can easily be gang supported between successive steps while being easily detachable individually for relocation.

SUMMARY OF THE INVENTION

This invention relates to an improved auxiliary safety step construction for round rung ladders. More specifically, the invention relates to an improved auxiliary safety step having simplified construction that is detachably mountable onto an existing ladder rung with a minimum of time and effort as compared to previous step constructions while readily lending to gang mounting between successive steps.

The foregoing is achieved in accordance with the invention by an auxiliary safety step construction particularly suited to round rung ladders of a type originally manufactured with fluted rungs defining longitudinal ribs uniformly spaced about the periphery. Such fluting is commonly provided on aluminum extension ladders.

Comprising the auxiliary safety step hereof is a body having a flat surface tread area sized to substantially span the length of the existing rungs. Beneath the tread the body is formed of a concave arcuate segment sized to overfit and embrace the periphery of the existing rung by extending over the rung from front to back. Along the exposed surface of the segment near its distal end, there are included two spaced apart parallel ribs extending longitudinally coextensive therewith. The spacing between the ribs corresponds to the arc spacing between adjacent grooves on the rungs. By means of this construction, installation of the step causes the ribs to interfit with the fluted rung for effecting an interlock against rotation of the step when subjected to an imposed loading. A set screw secures the auxiliary step to the individual rung to restrain separation of the interfit while a bar bracket pivotally supported on the rear of the body provides for interconnecting successive steps in ganged relation.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
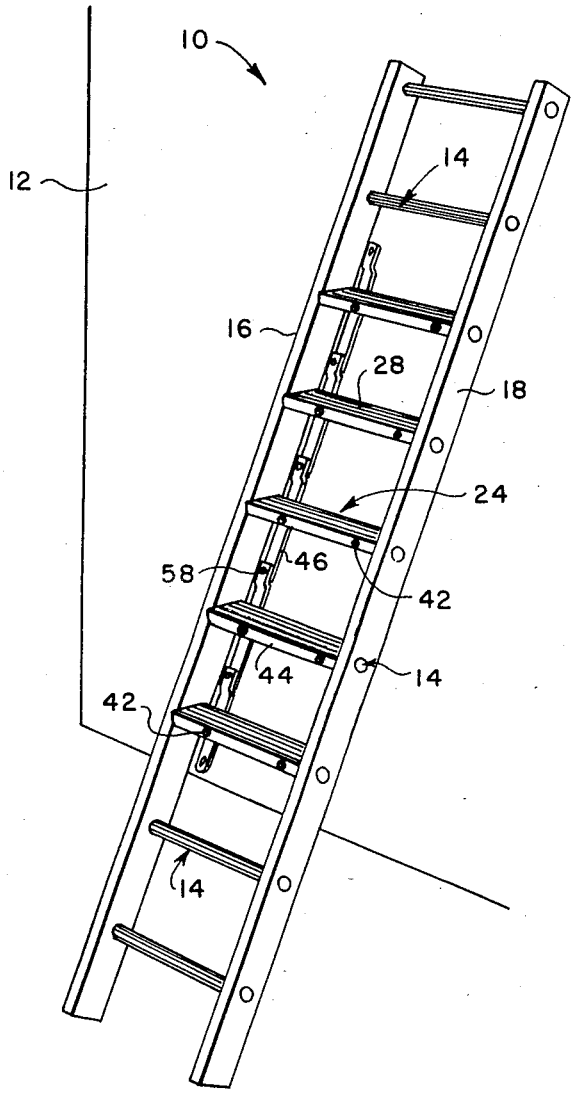
FIG. 1 is a perspective view of a ladder on which auxiliary safety steps of the invention have been installed.

In the description which follows, like parts are marked throughout the specification and drawings with the same reference numeral respectively. The drawing figures are not necessarily to scale and the proportions of certain parts have been exaggerated for purposes of clarity.

Figure 2:
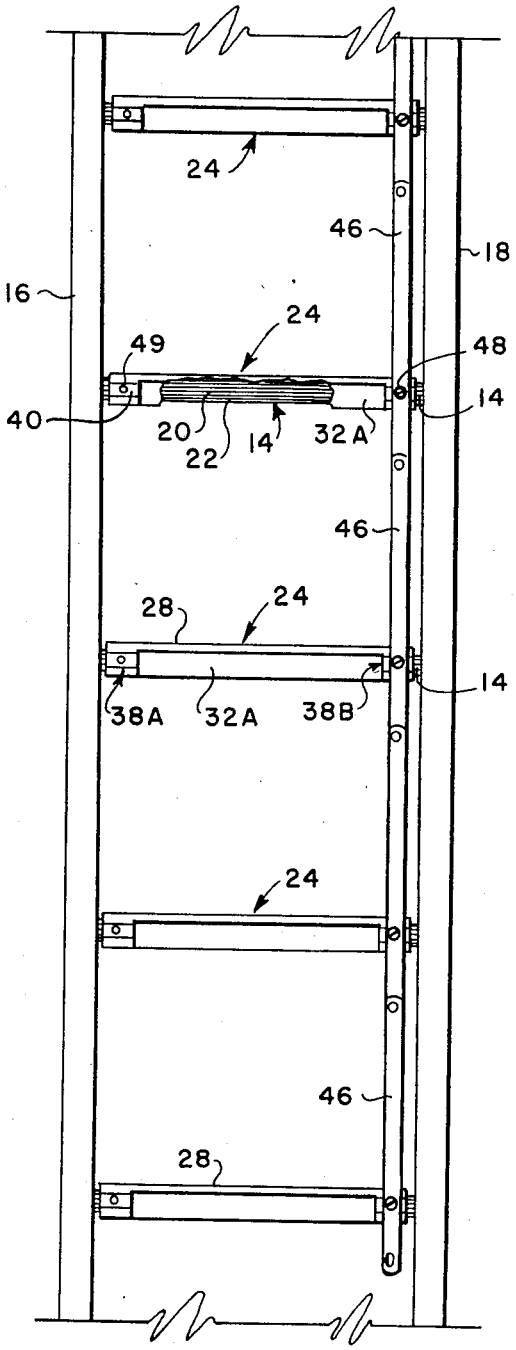
FIG. 2 is an enlarged rear elevation view, partly broken away, of the ladder of FIG. 1.
Figure 3:
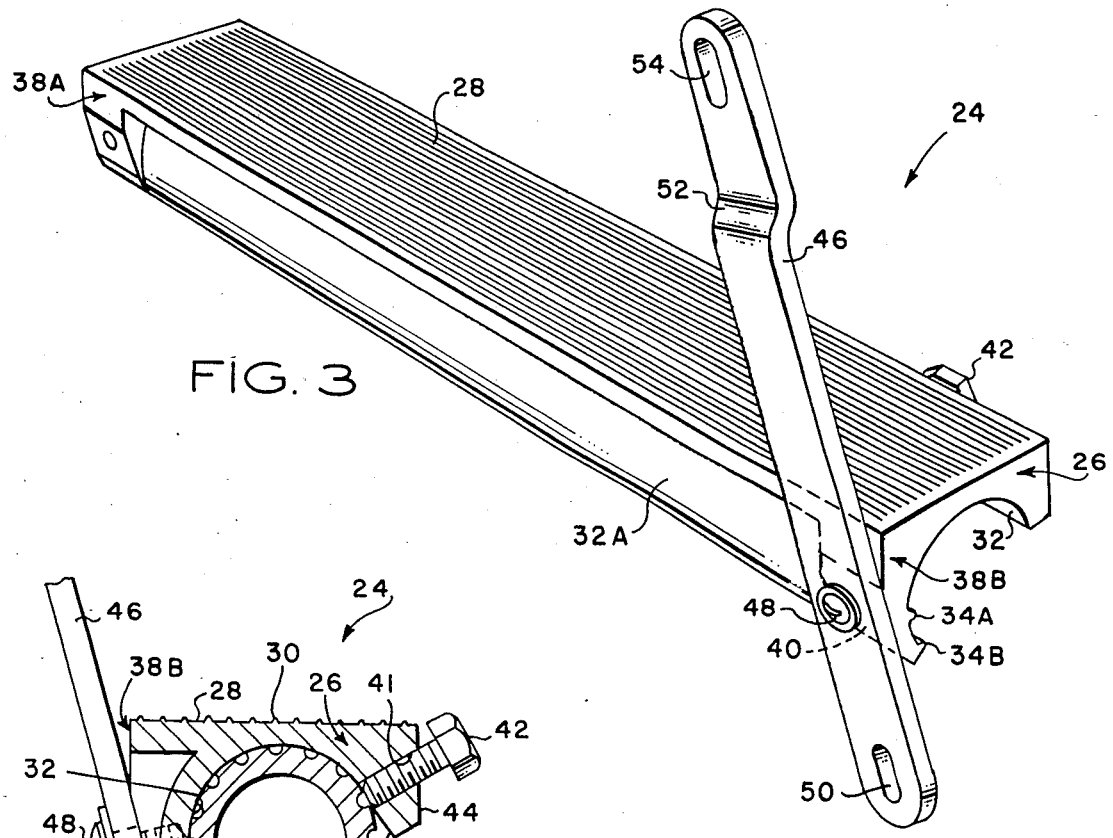
FIG. 3 is a perspective top view of the auxiliary safety step hereof.
Figure 4:
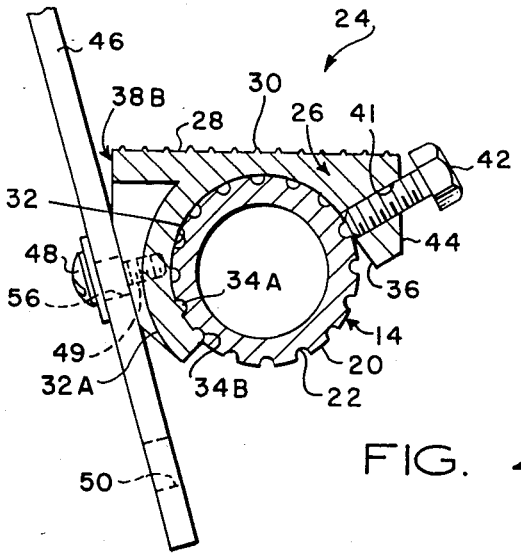
FIG. 4 is a sectional view taken along the lines of 4—4 of FIG. 3.
Figure 5:
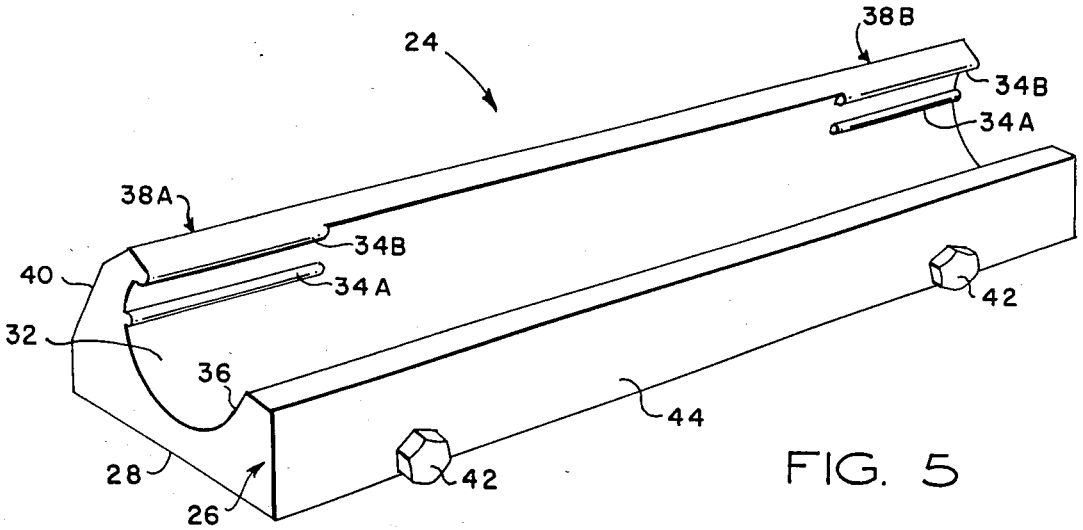
FIG. 5 is an underside perspective view of the auxiliary safety step as shown in FIG. 3.

Referring now to FIGS. 1–5 of the drawings, there is illustrated in FIG. 1 an extension ladder designated 10 in a leaning position against a wall 12. The ladder, which may be constructed of wood, is preferably of all aluminum construction having tubular, vertically spaced, round rungs 14 secured between side rails 16 and 18. For purposes hereof each rung 14 is of fluted construction thereby defining a plurality of longitudinal ribs 20 uniformly spaced about its periphery and separated by a plurality of longitudinal intervening grooves 22 (FIG. 4).

The auxiliary safety step hereof is designated 24 and includes a main body portion 26 which on its uppermost surface provides a flat tread 28. The tread surface is generally scored, grated or otherwise rendered tractionable and for that purpose may include a plurality of longitudinal ridges 30 as shown.

The underside of body 26 is constructed as an arcuate segment exposing a concave face 32 that is adapted when installed to extend over the top of rung 14 from front to back. The entire body 26 can be of any durable lightweight composition such as aluminum or a durable thermoplastic. On the distal sidewall 32A of step body 26 two parallel longitudinal ribs 34A, 34B are spaced apart on curved face 32 an arc distance corresponding to the spacing between adjacent rung grooves 22. A slight enlargement formed by a tangent surface 36 along the front edge of face 32 provides a clearance enabling the step 24 to be slip fitted onto a rung 14. During placement, the ribs 34A, 34B interfit the recesses 22 in the manner illustrated in FIG. 4. End blocks 38A, 38B provide structural reinforcement to the step body 26 for reacting the weight load imposed on tread 28. Each end block 38A, 38B has a planar surface 40 for engaging auxiliary support bars as described below.

With the ribs 34A, 34B interfitting the two adjacent recesses 22, the entire step 24 is secured in place by means of separate set screws 42 (FIG. 4) disposed in apertures 41 through front face 44 to engage a rib 20. When secured in the foregoing manner, the step 24 is interlocked against rotational slippage relative to the rung.

Since the ladder rung 14 may not be straight, the ribs 34A, 34B preferably are approximately three inches or less in width. That is, in the preferred embodiment, each safety step is provided with a first pair of ribs 34A, 34B and a second pair of ribs 34A, 34B located at opposite ends of the safety step. According to this arrangement, the safety step can be securely attached to a warped or sagging rung 14.

In order to enhance security of step 24 against slippage rotation about rung 14, a plurality of successive steps 24 may be similarly secured on successive rungs and interattached in ganged relation. For this purpose, each step 24 include a support bar 46 pivotally secured to the step by means of a bolt 48. An enlarged aperture 56 (FIG. 4) in bar 46 is adapted to receive bolt 48 which also extends through a threaded bore 49 formed in blocks 38A and 38B. This arrangement permits the bar 46 to be pivotally positioned either horizontally for storage or vertically for joinder to the bar of the next successive step below and above as will be explained. At one end, the bar 46 includes an elongated slot 50 and near the opposite end includes an offset 52 leading to an elongated slot 54 (FIG. 3).

When vertically aligned in the manner of FIGS. 1 and 2, the bottom slot 50 of one bar will overlap the top slot 54 of the adjacent bar such that the bars can be secured together with bolts 58. With the bars tandemly secured in this manner, they reinforce adjacent steps 24 whereby even those not sustaining an immediate load can contribute toward resisting rotation of any one or more steps on which a load is being imposed.

By the above description there is disclosed a novel auxiliary safety step for use with round rung ladders. By enabling each step to be installed with a slip-on fit and secured by set screws, dismounting and remounting involves a minimum of time and effort. Once each of the ribs 34A, 34B engage with adjacent grooves 22 of the ladder rung 20, it is only necessary to tighten set screws 42 in order to securely set the position of step 24. For enhanced reinforcement in securing each step to its respective rung, successive steps are secured together by use of elongated support bars 46 secured intermediate adjoining steps. In this manner, a plurality of auxiliary safety steps can be utilized simultaneously in a load sharing arrangement and yet they can be conveniently and quickly detached from their respective rungs.

Since changes could be made in the above construction and different embodiments of this invention could be made without departing from the scope thereof, it is intended that all matter contained in the drawings and specification shall be interpreted as illustrative and not in a limiting sense.

I claim:

1. An auxiliary safety step for a ladder of the type including round fluted rungs having alternate ribs and grooves formed about the periphery, said step comprising:

a traction body extending longitudinally between ends and defining a generally flat tread surface on which a loading is to be imposed;

a semi-cylindrical arcuate surface defined about the underside of said traction body for engagement with the periphery of a ladder rung on which the step is to be installed;

said traction body having longitudinal rib means extending laterally outward from said semi-cylindrical surface and adapted to interfit in a groove between adjacent ribs on the ladder rung to effect a rotational interlock therewith; and means for securing the step to a rung on which it is placed by restraining said rib/groove interfit against separation.

2. An auxiliary safety step as defined in claim 1, said traction body including a pair of parallel ribs for interfitting adjacent grooves on said rung.

3. An auxiliary safety step as defined in claim 1, said traction body having first and second opposite end portions, and said longitudinal rib means comprising first and second parallel ribs formed on said semi-cylindrical surface at said first traction body end portion and third and fourth parallel ribs formed on said semi-cylindrical surface at said second traction body end portion.

4. An auxiliary safety step as defined in claim 1 including at least one elongated bar secured to said traction body and adapted to interconnect with a second auxiliary safety step mounted on an adjacent rung of the ladder.

5. An auxiliary safety step as defined in claim 4 in which said bar is pivotally secured to said traction body for displacement between a first position for storage of the bar and a second position extended for attachment to a second bar on said second auxiliary safety step.

6. An auxiliary safety step as defined in claim 4 in which said bar includes an offset at one end for interfacing with the relatively opposite end of a second bar and there is included attachment means for detachably joining said bars together.

7. An auxiliary safety step as defined in claim 4 in which said bar is mounted intermediate the ends of said traction body.

8. An auxiliary safety step as defined in claim 4 in which said at least one bar includes a pair of bars secured spaced apart of said body.

9. An auxiliary safety step as defined in claim 1 in which said securing means comprises at least one set screw laterally extending through said traction body for engaging the periphery of a ladder rung on which the auxiliary step is installed.

* * * * *